US010994818B2

(12) United States Patent
Hernandez

(10) Patent No.: US 10,994,818 B2
(45) Date of Patent: May 4, 2021

(54) BOBBIN FOR AUTOMATIC INFLATOR

(71) Applicant: Halkey-Roberts Corporation, St. Petersburg, FL (US)

(72) Inventor: Kristopher Hernandez, St. Petersburg, FL (US)

(73) Assignee: Halkey-Roberts Corporation, St. Petersburg, FL (US)

( * ) Notice: Subject to any disclaimer, the term of this patent is extended or adjusted under 35 U.S.C. 154(b) by 0 days.

(21) Appl. No.: 16/375,256

(22) Filed: Apr. 4, 2019

(65) Prior Publication Data

US 2019/0308701 A1 Oct. 10, 2019

Related U.S. Application Data

(60) Provisional application No. 62/653,999, filed on Apr. 6, 2018.

(51) Int. Cl.
*B63C 9/19* (2006.01)
*B60C 29/00* (2006.01)

(52) U.S. Cl.
CPC . *B63C 9/19* (2013.01); *B63C 9/24* (2013.01)

(58) Field of Classification Search
CPC ..... B63C 9/19; B63C 9/24; B60C 29/00
USPC ..... 441/93
See application file for complete search history.

(56) References Cited

U.S. PATENT DOCUMENTS 3,059,814 A 10/1962 Poncel et al.
3,091,782 A 6/1963 Scalfani
3,426,942 A 2/1969 McMains
3,579,964 A 5/1971 Ohlstein
3,702,014 A 11/1972 Rabon et al.
3,757,371 A 9/1973 Martin
3,809,288 A 5/1974 Mackal
3,910,457 A 10/1975 Sutliff et al.
3,997,079 A 12/1976 Niemann
4,223,805 A 9/1980 Mackal
4,260,075 A 4/1981 Mackal
4,267,944 A 5/1981 Mackal
4,382,231 A 5/1983 Miller
4,436,159 A 3/1984 Revay
4,488,546 A 12/1984 Bernhardt et al.
4,513,248 A 4/1985 Miller
(Continued)

*Primary Examiner* — Anthony D Wiest
(74) *Attorney, Agent, or Firm* — GrayRobinson, P.A.

(57) ABSTRACT

A bobbin assembly for an automatic inflator including a generally cylindrical wall, a plurality of arms positioned in a ring centered about and parallel to a longitudinal axis of the bobbin, each arm being pivotably connected to a rim of the cylindrical wall by a living hinge, at least one of the arms including a radial seat extending toward the longitudinal axis of the bobbin to form an annular seat having a diameter to retain a head of a spring-loaded actuator pin of the automatic inflator to hold the spring-loaded actuator pin in a "cocked" position, a toroidal pill positioned between a lumen of the cylindrical wall and the ringed arms to retain the arms in position centered about and parallel to the longitudinal axis of the bobbin such that the annular seat maintains the diameter to retain the head of the spring-loaded actuator pin, thereby holding the spring-loaded actuator pin in the "cocked" position and a web interconnecting at least one of adjacent pairs of the arms allowing the paired arms to pivot outwardly via their respective living hinges in unison.

11 Claims, 9 Drawing Sheets

(56) References Cited

U.S. PATENT DOCUMENTS

| | | | | |
|---|---|---|---|---|
| 4,627,823 | A | 12/1986 | Mackal | |
| 5,076,468 | A | 12/1991 | Mackal | |
| 5,333,756 | A | 8/1994 | Glasa | |
| 5,370,567 | A | 12/1994 | Glasa | |
| 5,562,233 | A | 10/1996 | Glasa | |
| 5,601,124 | A | 2/1997 | Weinheimer | |
| 5,685,455 | A | 11/1997 | Glasa | |
| 5,694,986 | A | 12/1997 | Weinheimer et al. | |
| 6,705,488 | B2 | 3/2004 | Mackal et al. | |
| 7,572,161 | B2 | 8/2009 | Mackal et al. | |
| 8,353,736 | B2 * | 1/2013 | Wang | F04B 33/005 441/93 |
| 8,360,276 | B2 | 1/2013 | Rogier et al. | |
| 9,365,270 | B2 * | 6/2016 | Lee | B63C 9/155 |
| 2003/0049982 | A1 * | 3/2003 | Mackal | B63C 9/24 441/97 |
| 2006/0160444 | A1 * | 7/2006 | Campbell | B63C 9/24 441/95 |

* cited by examiner

BOBBIN FOR AUTOMATIC INFLATOR

CROSS-REFERENCE TO RELATED APPLICATIONS

This application claims the benefit of U.S. provisional patent application, Ser. No. 62/653,999, filed Apr. 6, 2018, the disclosure of which is hereby incorporated by reference herein.

BACKGROUND OF THE INVENTION

Field of the Invention

This invention relates to automatic inflators for inflatable articles such as life rafts, life vests, and the like. More particularly, this invention relates to inflators that are actuated automatically upon immersion in water.

Description of the Background Art

Presently, there exist many types of inflators designed to inflate inflatable articles such as personal floatation devices (life vests, rings and horseshoes), life rafts, buoys and emergency signaling equipment. Manual inflators typically comprise a body for receiving the neck of a cartridge of compressed gas such as carbon dioxide. A reciprocating pierce pin is disposed within the body of the inflator for piercing the frangible seal of the cartridge to permit compressed gas therein to flow into a manifold assembly of the inflator and then into the article to be inflated. Typically, a manually movable firing lever is operatively connected to the pierce pin such that the pierce pin pierces the frangible seal of the gas cartridge upon jerking of a ball lanyard. U.S. Pat. No. 3,809,288, the disclosure of which is hereby incorporated by reference herein, illustrates one particular embodiment of a manual inflator.

While manual inflators work suitably well, it was quickly learned that in an emergency situation, the person needing the assistance of the inflatable device, such as a downed aviator, injured person, or a man overboard, would fail or be unable to manually activate the inflator. Accordingly, it was realized that a means should be provided for automatically activating the inflator in such an emergency situation.

In response to this realized inadequacy of the prior art manual inflators, water-activated automatic inflators were developed which automatically actuate the pierce pin of the inflator when immersed in water thereby causing inflation of the inflatable device. Typical water-activated automatic inflators comprise a water activated actuator including a water destructible or dissolvable element, often referred to as a "bobbin", which retains a spring-loaded actuator pin in a cocked position in alignment with the pierce pin. Upon exposure to water, the dissolvable "pill" contained within the bobbin immediately starts dissolving and then destructs altogether, whereupon it loses its ability to hold-back the spring-loaded actuator pin in its cocked position. The spring-loaded actuator pin is thus released to forcibly move from its cocked position to an actuated position to strike the pierce pin, either directly or indirectly by means of an intermediate transfer pin. Upon striking the pierce pin, the pin fractures the seal of the cartridge thereby allowing the gas contained therein to flow into the inflatable device to inflate the same.

Representative automatic actuators for inflators are disclosed in U.S. Pat. Nos. 3,059,814, 3,091,782, 3,426,942, 3,579,964, 3,702,014, 3,757,371, 3,910,457, 3,997,079, 4,223,805, 4,267,944, 4,260,075, 4,382,231, 4,436,159, 4,513,248, 4,627,823, 5,076,468, 5,601,124, 5,685,455, 5,562,233, 5,370,567, 5,333,756, 4,488,546 and 5,694,986, the disclosures of which are hereby incorporated by reference herein.

A disadvantage to automatic inflators employing a dissolvable pill is the tendency to prematurely destruct in non-emergency situations by exposure of the pill to excessive humidity in the air. Bobbin pills of various designs and chemical compositions have been used to minimize their susceptibility to humidity.

Conversely, efforts to increase the humidity resistance of pills in bobbins sometimes leads to compositions and configurations of pills that are too resistant to dissolving in cold water (i.e., water approaching freezing temperatures). Resistance to dissolving in cold water therefore leads to delayed actuations. Delayed actuations are undesirable in applications that require the automatic inflator to automatically fire quickly (i.e., within a few seconds) after immersion in water.

For example, U.S. Pat. Nos. 6,705,488 and 7,572,161, the disclosures of which are hereby incorporated by reference herein, disclose various configurations for pills for bobbins of automatic inflators that seek to reduce susceptibility to humidity resulting in unintended or premature actuation while maintaining sufficient dissolvability in water so that the pill dissolves upon being submerged in water.

Therefore, it is an object of this invention to provide an improvement which overcomes the aforementioned inadequacies of the prior art devices and provides an improvement which is a significant contribution to the advancement of the inflation art.

Another object of this invention is to provide a humidity-resistant bobbin for an automatic inflator that is less susceptible to humid weather conditions that may undesirably prematurely activate the automatic inflator in non-emergency situations due to humidity.

Another object of this invention is to provide a cold-weather bobbin for an automatic inflator that actuates quickly after being submerged in freezing cold water.

These objects should be construed to be merely illustrative of some of the more prominent features and applications of the intended invention. Many other beneficial results can be obtained by applying the disclosed invention in a different manner or by modifying the invention within the scope of the disclosure. Accordingly, other objects and a more comprehensive understanding of the invention may be obtained by referring to the summary of the invention, and the detailed description of the preferred embodiment in addition to the scope of the invention defined by the claims taken in conjunction with the accompanying drawings.

SUMMARY OF THE INVENTION

The invention is defined by the appended claims with the specific embodiment shown in the attached drawings. For the purposes of summarizing the invention, the invention comprises a humidity-resistant, cold-weather bobbin for a water-activated automatic inflator that is less susceptible to humid weather conditions that may otherwise prematurely activate the automatic inflator while minimizing the amount of time it takes for the bobbin's pill to dissolve in freezing cold water.

Prior art bobbins comprise a circular housing having internally a collapsible annular ring of individually pivotal arms (e.g., eight arms) extending generally parallel to the axis of the bobbin. A toroidal, dissolvable pill is positioned about the ring of individually pivotal arms to retain them in their un-collapsed, generally-parallel position and to prevent them from collapsing outwardly. The individually pivotal arms each include an inwardly extending radial step, which collectively form an annular seat to retain a spring-loaded actuator in its cocked position. Upon dissolving of the pill when submerged in water, each of the individually pivotal arms and their steps, are allowed to individually pivot outwardly under the constant pressure of the actuator to a position no longer parallel to the axis of the bobbin. As the arms pivot outwardly, their respective steps likewise move outwardly to expand the diameter of the annular seat until such seat in no longer able to retain the actuator, thereby releasing (i.e., firing) the spring-loaded actuator to force a pierce pin into the frangible seal of a gas cartridge.

Typically, the pill of prior art bobbins comprise microcrystalline cellulose (e.g., Avicel® PH-102 manufactured by FMC Corporation, 1735 Market Street, Philadelphia, Pa. 19103) and an accelerant (e.g., AcDiSol accelerant) that is compressed into the desired configurations. This composition is selected for its characteristics of being resistant to moisture from humid weather conditions while maximizing compressive strength. The method of compressing the powder into the pill often produces an outer surface that resembles a thin skin that enhances the pill's resistance to humid weather conditions. Indeed, chemical additives may be combined with the cellulose powder to enhance the pill's resistance to humidity and increase its compressed forces.

The bobbin of the present invention similarly includes a collapsible annular ring of pivotal arms (e.g., eight arms), held in position by a dissolvable pill, to retain the spring-loaded actuator in its cocked position. However, unlike the prior art bobbins, in the present invention every other pair of adjacent pivotal arms are connected together by an interconnecting web so that they may only pivot outwardly in adjacent pairs instead of individually as in the case of the prior art. For example, in a bobbin having eight pivotal arms 1-8 forming the annular ring, arms 1 & 2, 3 & 4, 5 & 6 and 7 & 8 are respectively interconnected via a web to form 4 pairs of interconnected pivotal arms. Upon being submerged in water to dissolve the pill, because the paired, interconnected pivotal arms are interconnected via their respective web, they pivot outwardly together in paired unison under the pressure of the spring-loaded actuator, thereby firing the spring-loaded actuator.

In the best mode for implementing the invention, it has been found that webbing adjacent pivotal arms is preferred as described above; however, it should be appreciated that other webbed configurations are possible. For example, in a bobbin having eight arms, arms 1 & 2, 4 & 5 and 7 & 8, may be interconnected via a web, allowing unwebbed arms 3 and 6 free to pivot individually. As another example, in a bobbin having eight arms, arms 1 & 2 and 5 & 6 may be webbed together, allowing unwebbed arms 3, 4, 7 and 8 free to pivot individually.

Testing of the bobbin of the present invention against the prior art bobbins demonstrates that the average firing time in freezing cold water is improved from about 5.70-7.34 seconds to about 1.92-2.01 seconds.

The foregoing has outlined rather broadly, the more pertinent and prominent features of the present invention. The detailed description of the invention that follows is offered so that the present contribution to the art may be more fully appreciated. Additional features of the invention will be described hereinafter. These form the subject of the claims of the invention. It should be appreciated by those skilled in the art that the conception and the disclosed specific embodiment may be readily utilized as a basis for modifying or designing other methods and structures for carrying out the same purposes of the present invention. It should also be realized by those skilled in the art that such equivalent structures do not depart from the spirit and scope of the invention as set forth in the appended claims.

BRIEF DESCRIPTION OF THE DRAWINGS

For a more succinct understanding of the nature and objects of the invention, reference should be directed to the following description taken in conjunction with the accompanying drawings in which.

Similar reference numerals refer to similar parts throughout the several figures.

DETAILED DESCRIPTION OF THE PREFERRED EMBODIMENT

Figure 1:
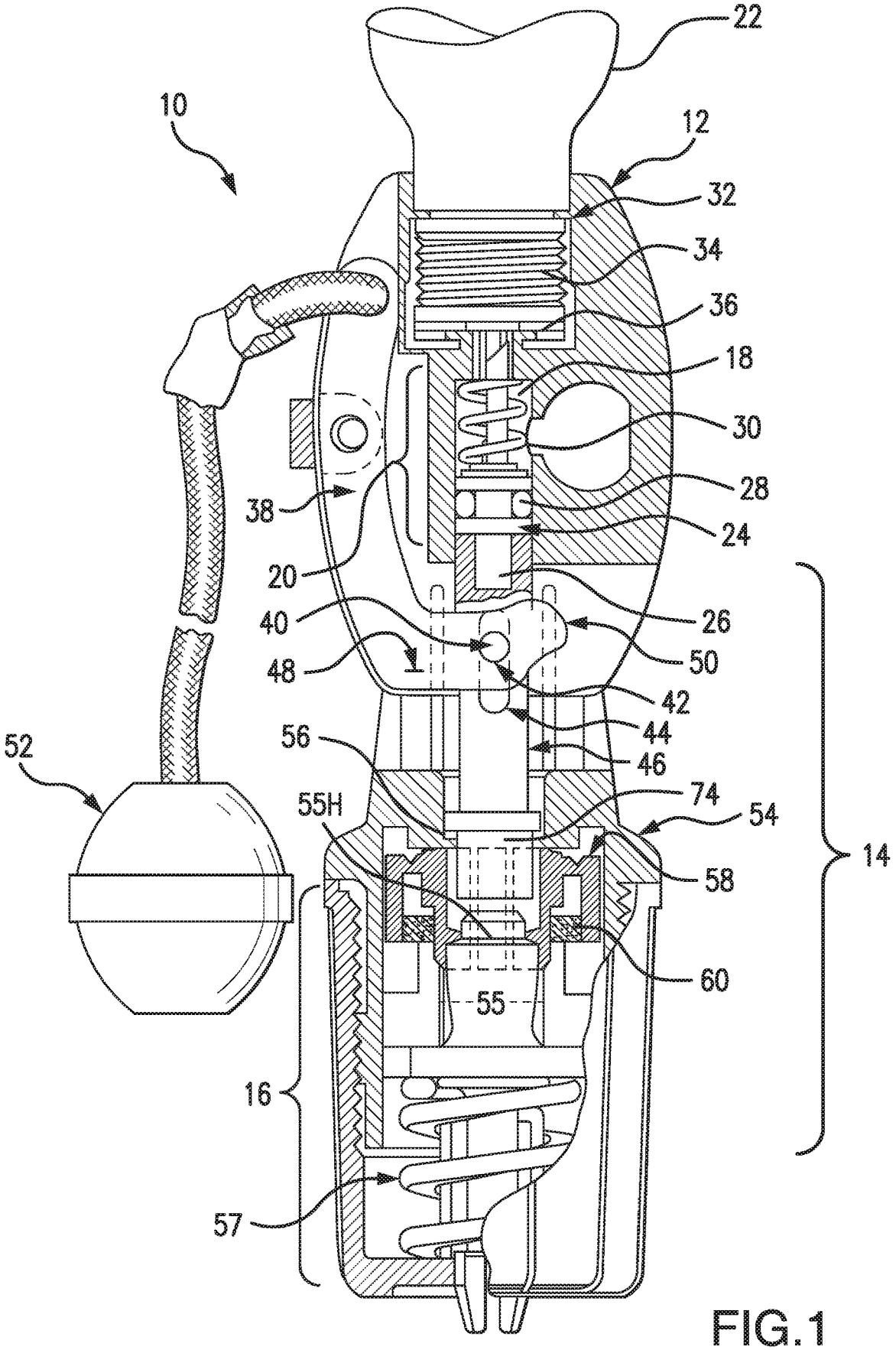
FIG. 1 is a longitudinal cross-sectional view of an exemplary automatic inflator assembly showing the various internal parts and their relative position to one another.

FIG. 1, copied from U.S. Pat. No. 5,601,124, illustrates an exemplary prior art automatic inflator 10 as comprising an inflator body 12, an actuator body assembly 14, and a cylindrical cap assembly 16. The inflator body 12 has a longitudinal central bore, generally indicated by numeral 18, which is sized to receive a pierce pin assembly 20 reciprocatably positioned therein. A gas-containing cartridge 22 is threadably coupled to the inflator body in alignment with the pierce pin assembly 20.

The pierce pin assembly 20 comprises a pierce pin 24 having an end portion 26, a sealing gasket 28, and a small compression spring 30. A conventional metal insert 32, having interior threads 34 and gasket 36, is molded in situ within the inflator body 12. The gas-containing cartridge 22 is threaded into the metal insert 32. The frangible seal of the gas cartridge 22 is pierced when the pierce pin assembly 20 is forcibly moved towards the cartridge 22.

The automatic inflator 10 may be fired automatically upon immersion in water or manually. The manual actuator means includes a generally L-shaped lever 38 pivotally mounted to the inflator body 12 by a pivot pin 40 which passes through the inflator body 12, a hole 42 located in the distal portion of the lever 38, and a second slot portion 44 of an intermediate transfer pin 46. The pivot pin 40 also serves to fixedly secure the actuator body assembly 14 to the inflator body 12.

The distal end portion 48 of the lever 38 has a cam extension 50. A lanyard handle 52 is tethered to the lever 38. When the lanyard handle 52 is pulled, the cam extension 50 forcibly engages the end 26 of the pierce pin assembly 20, thereby causing the gas-containing cartridge 22 to be pierced.

The actuator body assembly 14 is generally comprised of an actuator body 54, an actuator pin 55, the intermediate transfer pin 46, a conventional O-ring 56, and a bobbin 58. A heavy spring 57 forcibly urges the head 55H of the actuator pin 55 against the bobbin 58.

Figure 2:
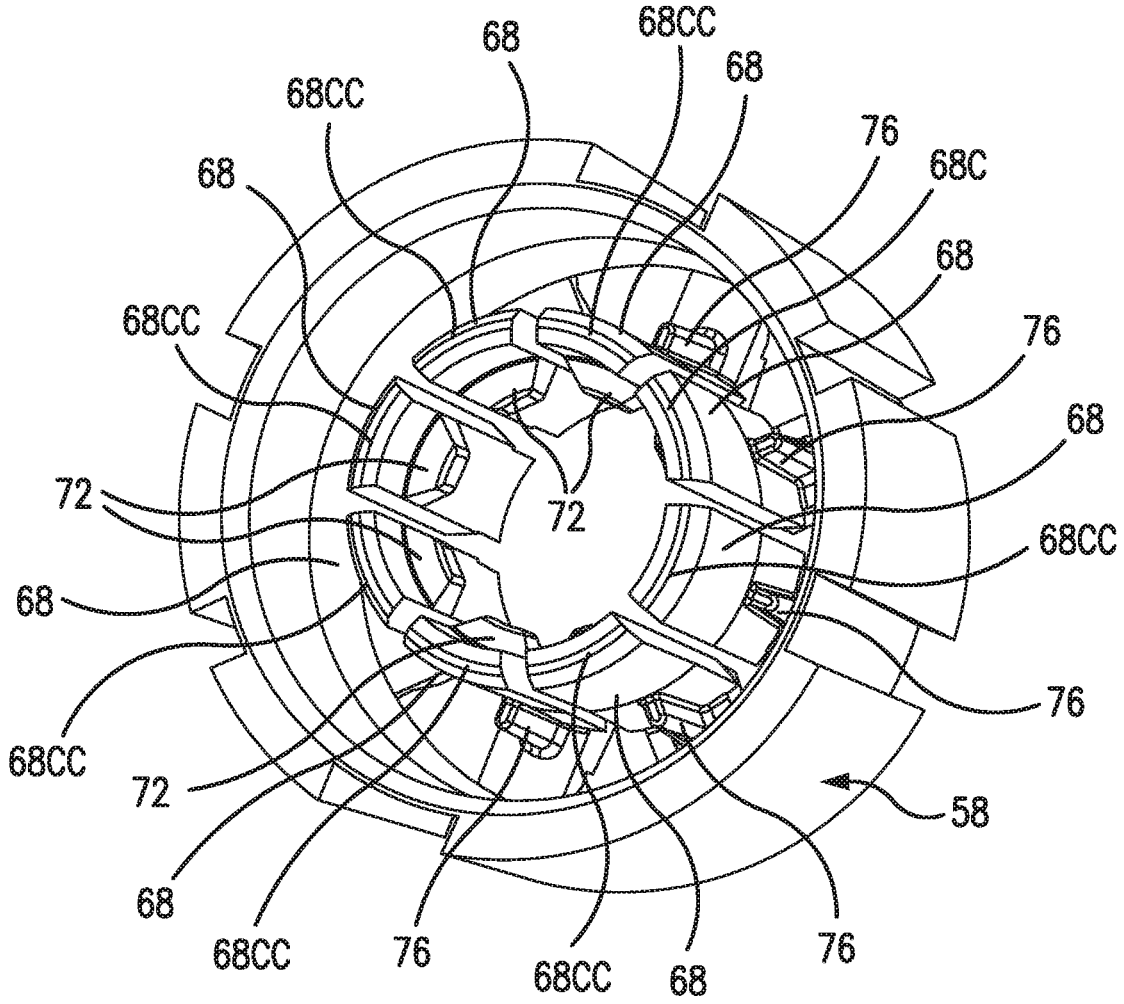
FIG. 2 is a bottom perspective view of a prior art bobbin comprising a circular housing with a collapsible annular ring of individually pivotal arms (e.g., eight arms) extending generally parallel to the axis of the bobbin.
Figure 3:
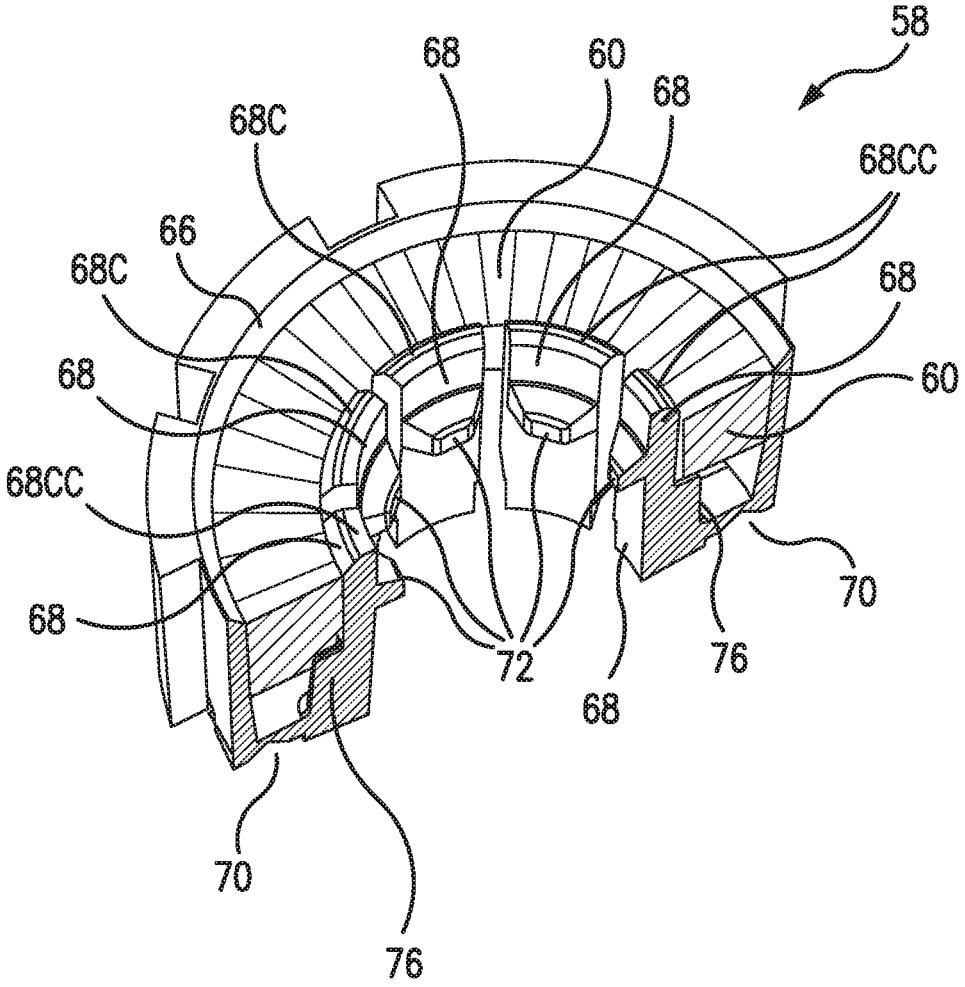
FIG. 3 is a cross-sectional view of FIG. 2 along lines 2-2 showing the toroidal, dissolvable pill (e.g., U.S. Pat. No. 7,572,161) positioned about the ring of pivotal arms to retain the individually pivotal arms in their un-collapsed, generally-parallel position and to prevent them from collapsing outwardly.
Figure 4:
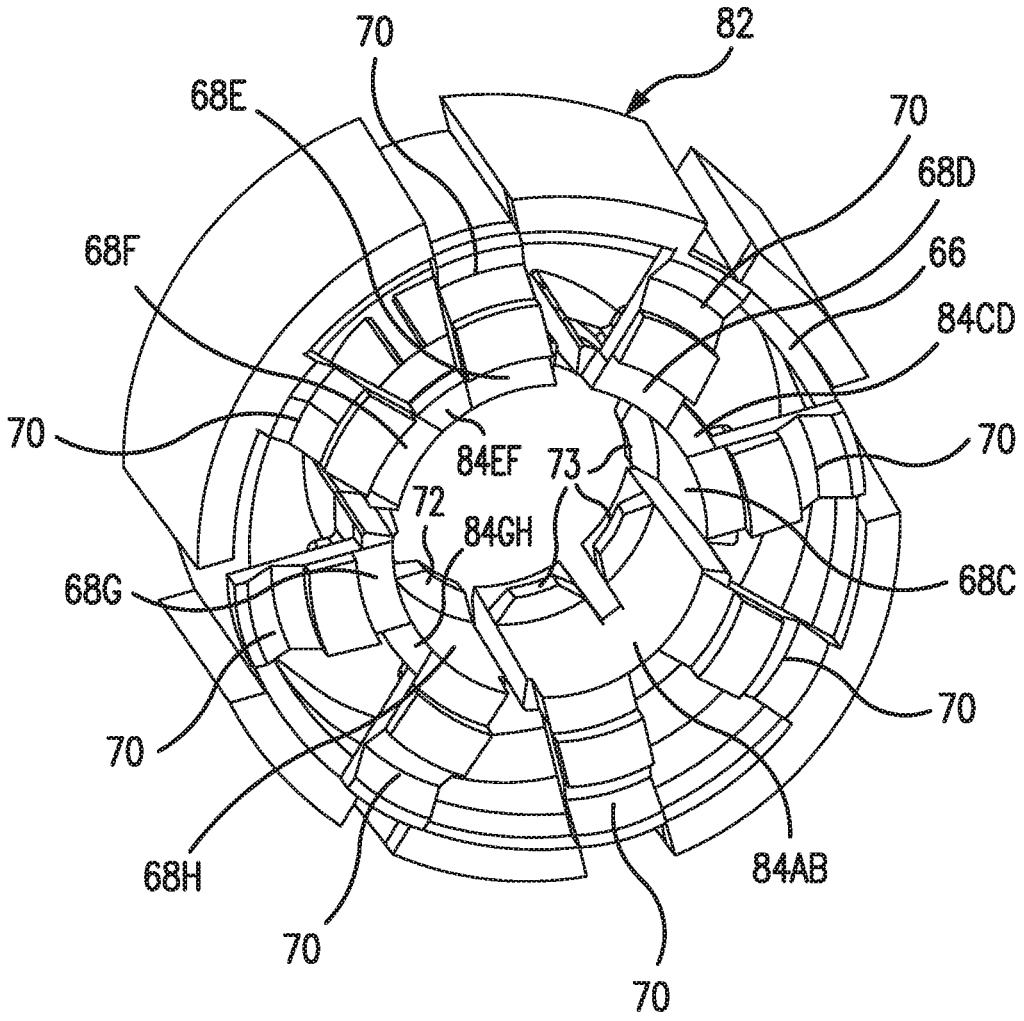
FIG. 4 is a top perspective view of the bobbin of the invention in which every other pair of adjacent pivotal arms are connected together by an interconnecting web.
Figure 5:
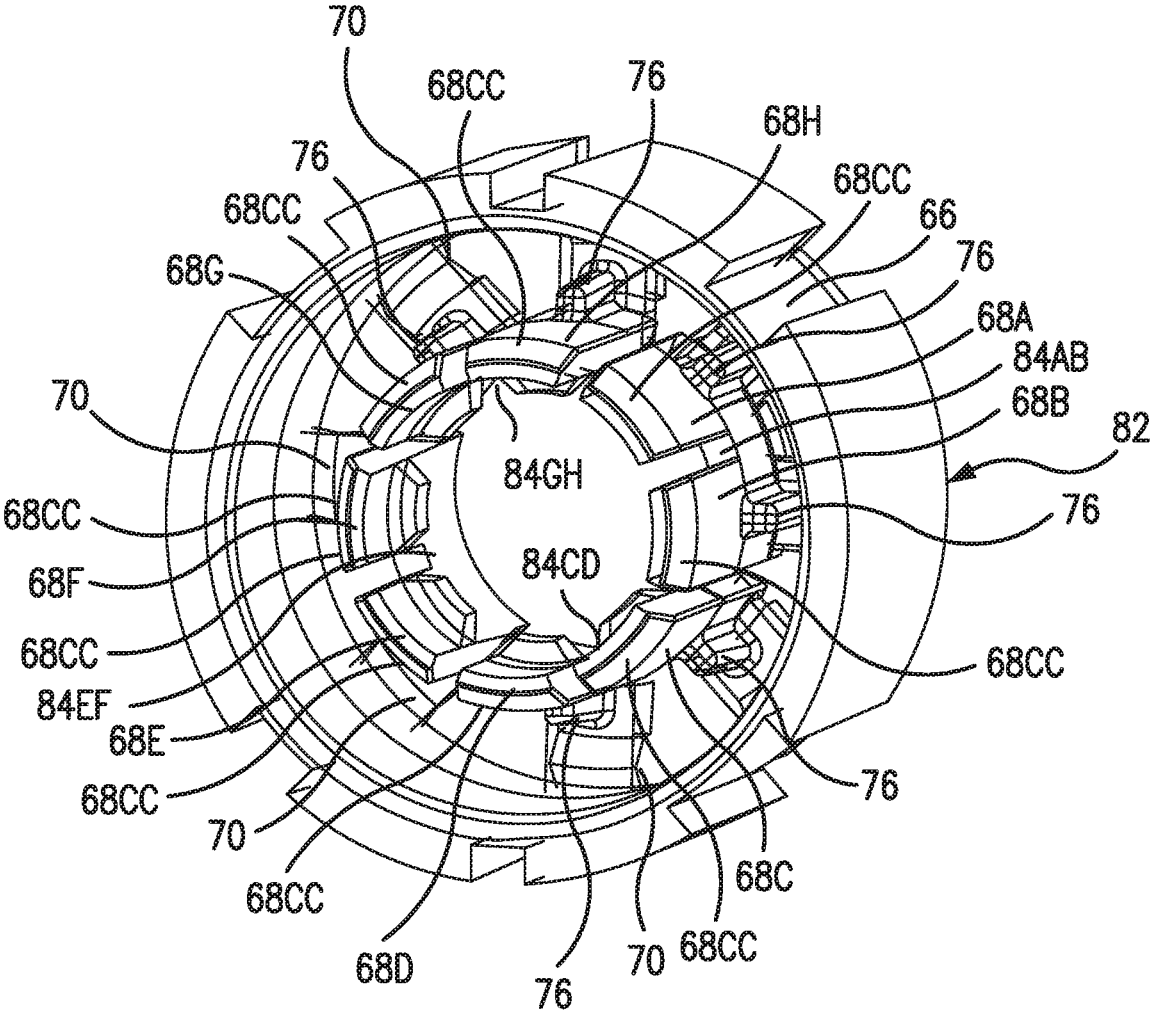
FIG. 5 is a bottom perspective view of the bobbin of the invention.
Figure 6:
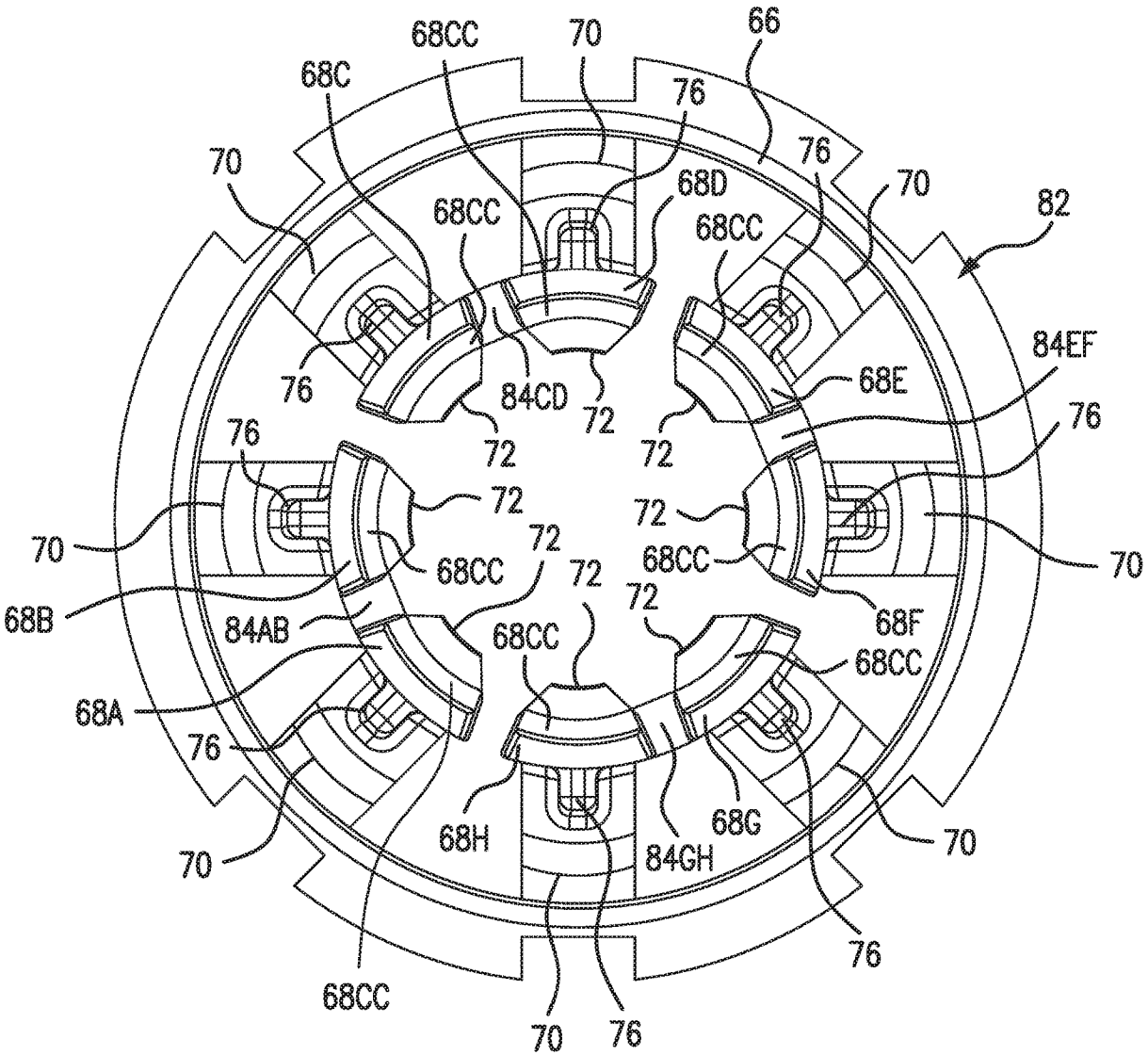
FIG. 6 is a bottom view of the bobbin of the invention without the pill installed.
Figure 7:
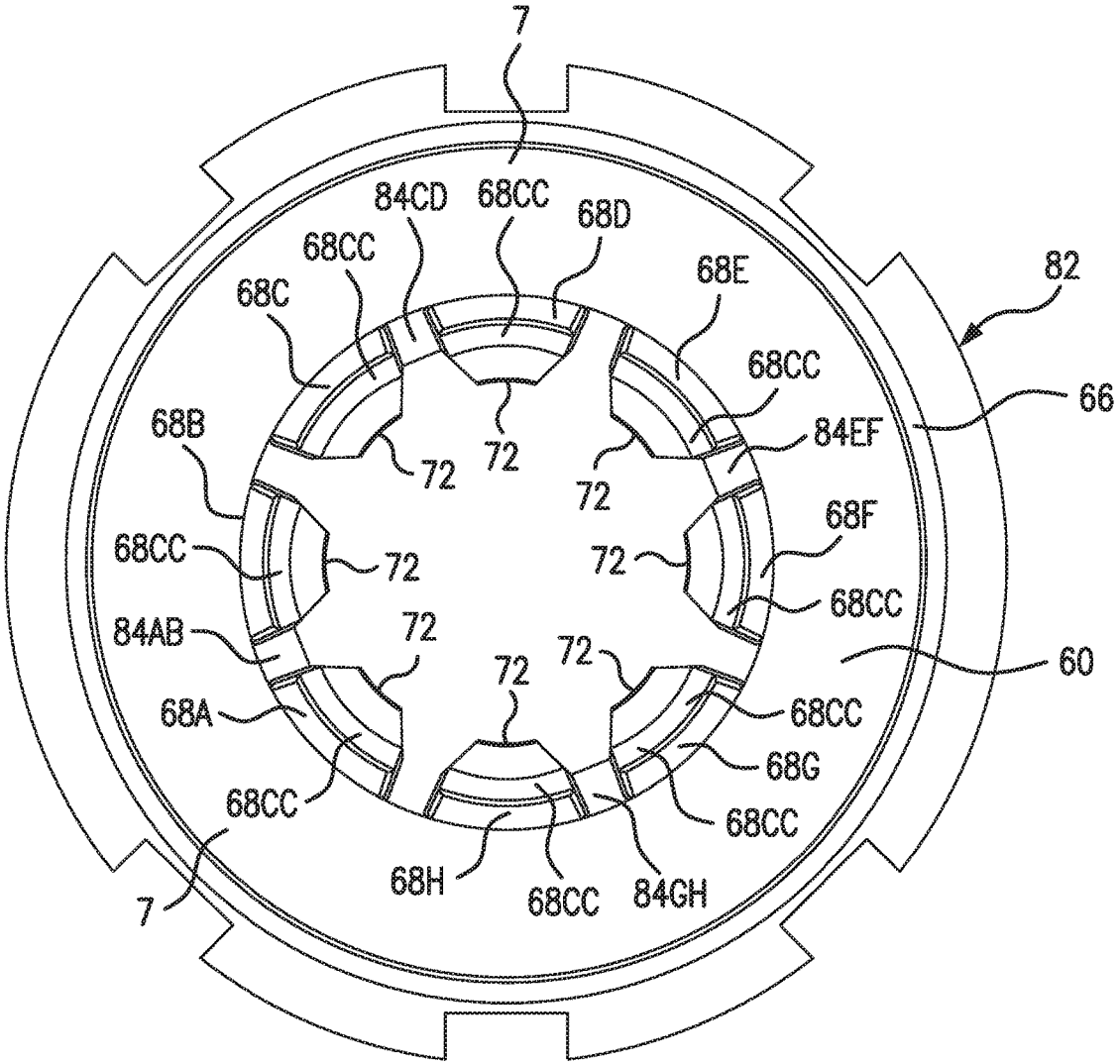
FIG. 7 is a bottom view of the bobbin of the invention with the toroidal, dissolvable pill installed about the ring of pivotal arms to retain the webbed arms in their un-collapsed, generally-parallel position and to prevent them from collapsing outwardly.
Figure 8:
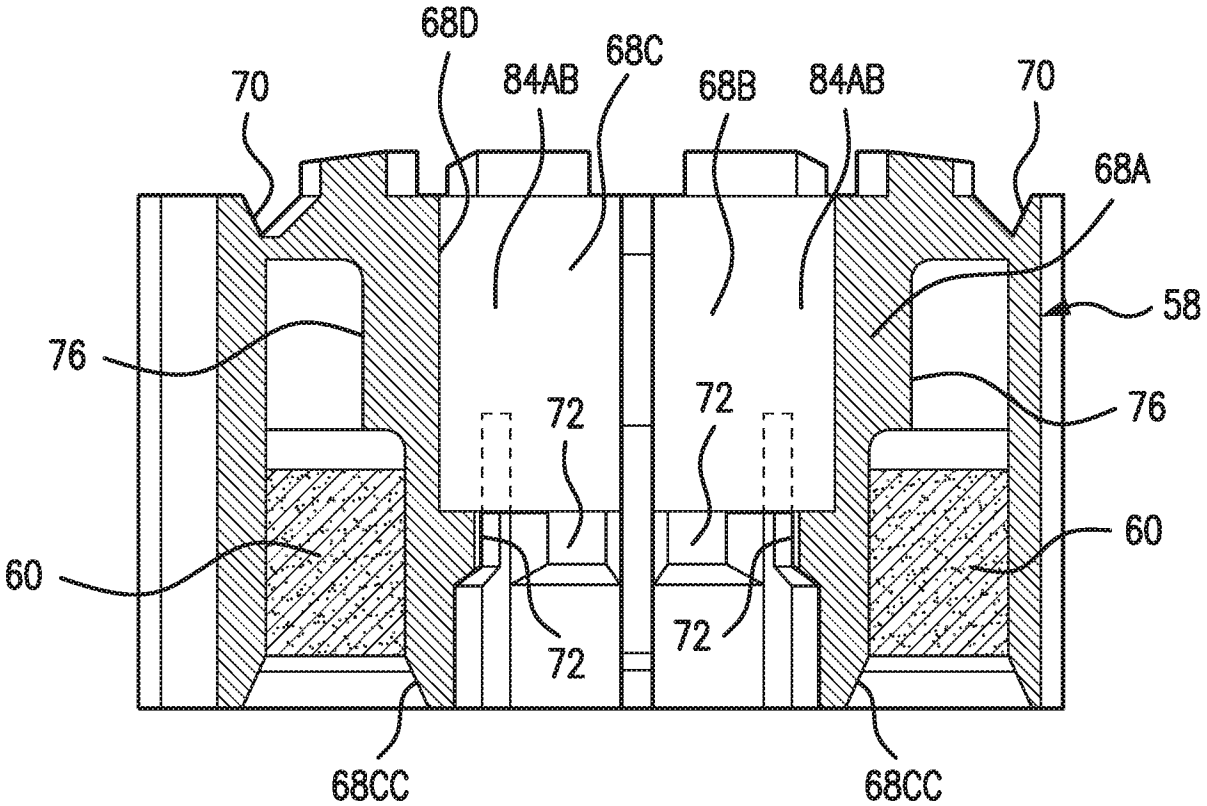
FIG. 8 is a cross-sectional view of FIG. 7 along lines 8-8.
Figure 9:
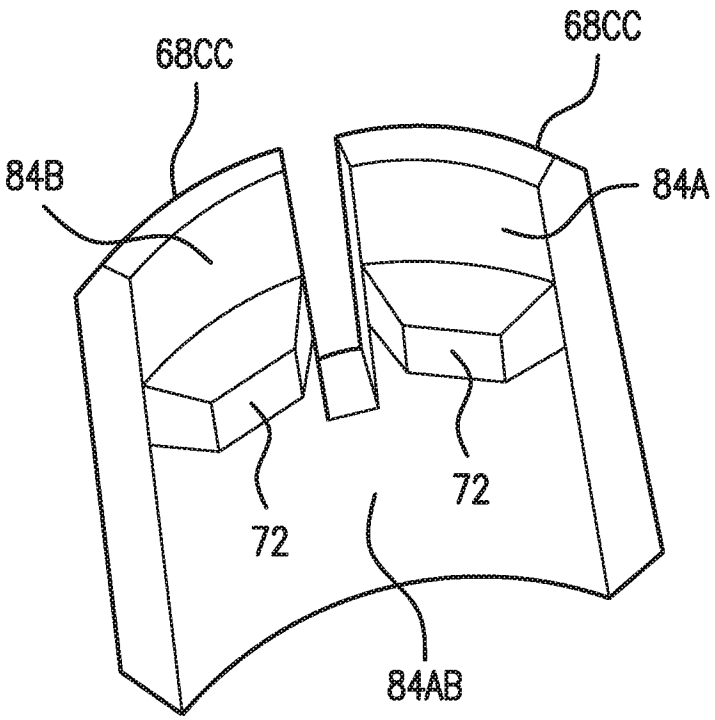
FIG. 9 is a partial view of the bobbin of the invention showing adjacent webbed arms.

As better shown in FIGS. 2-3, an exemplary prior art bobbin 58 includes a dissolvable pill 60. The bobbin 58 comprises a generally cylindrical wall 66. A plurality of arms 68 positioned in a ring centered about and parallel to the longitudinal axis of the bobbin 58, are individually pivotably connected to the rim of the cylindrical wall 66 by a living hinge 70.

Each of the arms 68 individually include a radial seat 72 extending toward the longitudinal axis of the bobbin 58. Collectively, the individual radial seats 72 form an annular seat having a diameter sized to capture and retain the head 55H of the spring-loaded actuator pin 55, thereby holding the spring-loaded actuator pin 55 back against the force of the spring 57 in a "cocked" position.

The toroidal pill 60 is positioned between the lumen of the cylindrical wall 66 and the ringed arms 68 to retain the arms 68 in position centered about and parallel to the longitudinal axis of the bobbin 58 such that the annular seat formed by their radial seats 72 maintain the diameter sized to capture and retain the head 55H of the spring-loaded actuator pin 55, thereby holding the spring-loaded actuator pin 55 back against the force of the spring 57 in a "cocked" position.

It is noted that each arm 68 may include a buttress 76 extending from the living-hinge end of the arm 68 along a length of the arm 68. The buttress 76 provides additional rigidity to the arm 68 and, during assembly, serves to limit the distance the pill 60 is pushed onto the length of the ringed arms 68. Further, it is noted that each of the arms 68 may include a chamfered end 68CC to facilitate automatic centering and pushing of the pill 60 onto the ringed arms 68.

After assembly, once the pill 60 is dissolved in water, the ringed arms 68 are allowed to flex radially outwardly individually via their respective living hinge 70 under the pressure of the spring-loaded actuator pin head 55H. As they flex outwardly, their radial seats 72 spread apart until they reach an increased diameter that they no longer form an annular seat for the head 55H of the actuator pin 55, whereupon the head 55H of the spring-loaded actuator pin 55 is released and moves forcibly under the force of the spring 57 to actuate the pierce pin 20 via the transfer pin 46 (i.e., the actuator 10 is automatically "fired").

It can be appreciated that the pill 60 must have sufficient strength to hold the arms 68 in their parallel position to hold-back spring-loaded actuator pin 55 and yet must be dissolvable once exposed to water to allow the arms 68 to flex radially outwardly and allow the actuator pin 55 to fire.

The bobbin 82 of the present invention is illustrated in FIGS. 4-9. The bobbin 82 of the present invention includes components similar to those of the prior art bobbin 58. Accordingly, for uniformity and clarity, in FIGS. 4-9, the same reference numerals used in connection with the prior art bobbin 58 are used when describing the bobbin 82 of the present invention.

As seen in FIGS. 4-9, the bobbin 82 of the present invention comprises a generally cylindrical wall 66 having a plurality of arms 68 pivotably connected to the rim of the cylindrical wall 66 by a living hinge 70 to extend into the cylindrical wall 66 and positioned in a ring centered about and parallel to the longitudinal axis of the bobbin 58 such that their respective radial seats 72 form an annular seat having a diameter sized to capture and retain the head 55H of the spring-loaded actuator pin 55, thereby holding the spring-loaded actuator pin 55 back against the force of the spring 57 in a "cocked" position.

Unlike the prior art, the arms 68 are grouped in pairs and the two arms 68 of each pair are interconnected to each other by a web 84. The paired arms 68 interconnected by the web 84 pivot outwardly via their respective living hinges 70 in unison, rather than individually as in the case of the prior art.

As shown, in a bobbin 82 having eight arms 68A-68H, preferably, adjacent arms 68A & 68B, 68C & 68D, 68E & 68F and 68G & 68H are paired and interconnected by their respective webs 84AB, 84CD, 84EF and 84GH. Without departing from the spirit and scope of the invention, other pairing arrangements may be desired as noted above in the summary of the invention.

Each of the interconnecting webs (e.g., shown in FIG. 9 as 84AB) preferably extends integrally between adjacent arms (e.g., shown in FIG. 9 as 68A & 68B) approximately equal to the height of the buttresses 76. Each interconnecting web 84 is also preferably thin in structure but arcuately curved to match the outward curvature of the ringed arms 68. Also, all of the components of the bobbin 82 including the interconnecting webs 84 are preferably integrally molded.

Unexpectedly, the webbed, interconnected arms 68 of the present invention have significantly increased the ability of the pill 60 to be humidity resistant yet quickly dissolvable in cold water.

The present invention includes that contained in the appended claims as well as that of the foregoing description. Although this description has been described in its preferred form with a certain degree of particularity, it should be understood that the present disclosure of the preferred form has been made only by way of example and that numerous changes in the details of construction, combination, or arrangement of parts thereof may be resorted to without departing from the spirit and scope of the invention.

Now that the invention has been described,

What is claimed is:

1. A bobbin assembly for an automatic inflator, comprising in combination:

a generally cylindrical wall;

a plurality of arms positioned in a ring centered about and parallel to a longitudinal axis of the bobbin, each arm being pivotably connected to a rim of said cylindrical wall by a living hinge;

at least one said arms including a radial seat extending toward said longitudinal axis of the bobbin to form an annular seat having a diameter to retain a head of a spring-loaded actuator pin of the automatic inflator to hold the spring-loaded actuator pin in a "cocked" position;

a toroidal pill positioned between a lumen of said cylindrical wall and said ringed arms to retain said arms in position centered about and parallel to said longitudinal axis of the bobbin such that said annular seat maintains said diameter to retain the head of the spring-loaded actuator pin, thereby holding the spring-loaded actuator pin in the "cocked" position until, upon immersion in water, said pill begins to dissolve whereupon said pill no longer retains said arms in position to retain the head of the head of the spring-loaded actuator pin thereby releasing the head causing actuation of the spring-loaded actuator pin; and a web interconnecting at least one of adjacent pairs of said arms allowing said paired arms to pivot outwardly via their respective said living hinges in unison.

2. The bobbin as set forth in claim 1, wherein at least one of said arms include a buttress extending from its living-hinge end of said arm along a length of said arm to provide additional rigidity to said arm.

3. The bobbin as set forth in claim 2, wherein said buttress limits the distance said pill may be pushed onto a length of said ringed arms.

4. The bobbin as set forth in claim 3, wherein said arms include a chamfered end to facilitate automatic centering and pushing of said pill onto said ringed arms.

5. The bobbin as set forth in claim 4, wherein once said pill dissolves in water, said ringed arms are allowed to flex radially outwardly via their respective said living hinge under the pressure of the spring-loaded actuator pin head, whereupon their respective said radial seats spread apart to an increased diameter that no longer forms said annular seat for the head of the spring-loaded actuator pin, thereby releasing the head of the spring-loaded actuator pin to actuate the inflator.

6. The bobbin as set forth in claim 2, wherein at least one of said interconnecting webs extends integrally between adjacent arms approximately equal to a height of their respective said buttresses.

7. The bobbin as set forth in claim 1, wherein said pill has strength to hold said arms in said parallel position to hold back the spring-loaded actuator pin.

8. The bobbin as set forth in claim 1, wherein said pill is dissolvable once exposed to water to allow said arms to flex radially outwardly and release the spring-loaded actuator pin.

9. The bobbin as set forth in claim 1, including eight said arms forming four said adjacent paired arms, each paired arms being interconnected by their respective said webs.

10. The bobbin as set forth in claim 1, wherein at least one of said webs is thin in structure and arcuately curved to match an outward curvature of said ringed arms.

11. The bobbin as set forth in claim 1, wherein said bobbin is integrally molded.

* * * * *